US008808074B2

(12) United States Patent
Kim

(10) Patent No.: US 8,808,074 B2
(45) Date of Patent: Aug. 19, 2014

(54) MOTORIZED DIFFUSER

(75) Inventor: Song Yee Kim, Gyeonggi-do (KR)

(73) Assignee: Omnivent Corporation (KR)

( * ) Notice: Subject to any disclaimer, the term of this patent is extended or adjusted under 35 U.S.C. 154(b) by 424 days.

(21) Appl. No.: 13/144,567

(22) PCT Filed: May 14, 2009

(86) PCT No.: PCT/KR2009/002566

§ 371 (c)(1),
(2), (4) Date: Jul. 14, 2011

(87) PCT Pub. No.: WO2010/085026

PCT Pub. Date: Jul. 29, 2010

(65) Prior Publication Data

US 2011/0275306 A1 Nov. 10, 2011

(30) Foreign Application Priority Data

Jan. 20, 2009 (KR) ..... 10-2009-0004403

(51) Int. Cl.
*F24F 7/00* (2006.01)
*F24F 13/062* (2006.01)
*F24F 13/14* (2006.01)

(52) U.S. Cl.
CPC ..... *F24F 13/062* (2013.01); *F24F 2013/1433* (2013.01)
USPC ..... 454/254; 454/256; 454/265; 454/322; 454/339

(58) Field of Classification Search
CPC ..... F24F 13/062; F24F 2013/1443
USPC ..... 454/254–256, 258, 302, 303, 324; 236/49.1, 49.3, 49.4, 49.5
See application file for complete search history.

(56) References Cited

U.S. PATENT DOCUMENTS 3,537,380 A * 11/1970 Newell et al. ..... 454/256
3,768,395 A * 10/1973 Rick ..... 454/302
4,145,961 A * 3/1979 Lolli ..... 454/312
4,181,253 A * 1/1980 Barlow ..... 236/49.2

(Continued)

FOREIGN PATENT DOCUMENTS

CN 1765484 5/2006
JP 6-11177 A 1/1994
JP 6-207732 A 7/1994
KR 10-0296421 B1 10/2001

OTHER PUBLICATIONS

International Search Report for International Application No. PCT/KR2009/002566 with English translation mailed Jan. 13, 2010.

*Primary Examiner* — Steven B McAllister
*Assistant Examiner* — Frances H Kamps
(74) *Attorney, Agent, or Firm* — Cantor Colburn LLP

(57) ABSTRACT

Disclosed is a motorized diffuser which is shut when not in use and which reduces energy consumption in a building, eliminates the necessity of a maintenance hole, prevents contamination, has a simple configuration, and enables easy maintenance when applied in a cooling/heating system adopting a proportional air flow control scheme. According to the disclosed diffuser, a diffuser cone includes: a diffuser cone body which forms a fluid passage on the outer surface thereof which is disposed between the diffuser cone body and a diffuser casing when the diffuser cone is opened; a diffuser cone cover fixed to the diffuser cone body such that the diffuser cone cover can be assembled/disassembled to/from the diffuser cone body with a space therebetween; and a motor means fixedly installed in the space.

6 Claims, 4 Drawing Sheets

(56) References Cited

U.S. PATENT DOCUMENTS

| | | | | | |
|---|---|---|---|---|---|
| 4,616,559 | A * | 10/1986 | Barlow | 454/298 |
| 5,556,335 | A * | 9/1996 | Holyoake | 454/258 |
| 5,860,592 | A * | 1/1999 | Dozier et al. | 236/49.3 |
| 5,868,313 | A * | 2/1999 | Weng | 236/49.3 |
| 6,176,777 | B1 * | 1/2001 | Smith et al. | 454/256 |
| 6,857,577 | B2 * | 2/2005 | Hunka | 236/49.5 |
| 2006/0292977 | A1 * | 12/2006 | Caldwell et al. | 454/256 |
| 2007/0111655 | A1 * | 5/2007 | Song et al. | 454/292 |
| 2007/0184776 | A1 * | 8/2007 | Caldwell et al. | 454/290 |
| 2009/0170419 | A1 * | 7/2009 | Holyoake | 454/258 |
| 2011/0034120 | A1 * | 2/2011 | Jaiyeola | 454/335 |

* cited by examiner

MOTORIZED DIFFUSER

CROSS-REFERENCE TO RELATED APPLICATIONS

This is a U.S. national stage application of International Application No. PCT/KR2009/002566, filed on 14 May 2009. Priority under 35 U.S.C. 119(a) and 35 U.S.C. 365(b) is claimed from Korean Application No. KR10-2009-0004403, filed 20 Jan. 2009, the disclosure of which is also incorporated herein by reference.

TECHNICAL FIELD

The present invention relates to a motorized diffuser for cooling/heating or ventilation, which is provided in a ceiling indoors by being connected to an inside duct.

BACKGROUND ART

A variable air volume control box (VAV box) and a thermostat have been conventionally provided and generally used in order to control an air volume appropriate for a region to be air conditioned. Also, based on a nationally administered law on apartment house ventilation, many apartments have been equipped with ventilation equipment for forced ventilation.

In a configuration where an opening rate is controlled by driving a motor, the motor is provided in a flow passage or provided outside a diffuser or a duct. Such a structure has a problem in that for maintenance, disassembling and assembling are complicated to perform, and also, an additional maintenance hole has to be provided in a ceiling.

DISCLOSURE

Technical Problem

Therefore, the present invention has been made in view of the above-mentioned problems, and the present invention provides a motorized diffuser or a diffuser-cone for cooling/heating or ventilation, in which the diffuser is opened only for use and is employed for cooling/heating through proportional air-volume control, and thus can greatly reduce an initial investment cost and energy consumption, compared to a VAV system. Furthermore, in a case where the diffuser is employed for ventilation facility of a house, an automatic open/close function of the diffuser allows an actual space requiring ventilation to be ventilated, thereby greatly reducing fan power. Also, it does not require a ceiling maintenance hole, so that a ceiling can be beautifully configured. Meanwhile, there is no obstruction to the flow passage, thereby removing the possibility of pollution to a driving part. Moreover, the diffuser has a simple configuration and requires only simple maintenance.

Especially, the diffuser according to the present invention has a performance superior to the costly VAV system, can reduce an initial investment cost up to 50% or more, and can reduce a driving cost for the use. Also, the diffuser can selectively ventilate a required space while a conventional system ventilates the entire house as well as a specific room requiring ventilation. Thus, it is possible to greatly reduce the consumption of electric energy.

Technical solution

In accordance with an aspect of the present invention, there is provided a diffuser having a diffuser cone with a square- or circular-cross section, and a diffuser casing, wherein the diffuser cone is provided with respect to the diffuser casing in such a manner that an opening rate of a flow passage at an outer periphery between the diffuser cone and the diffuser casing can be controlled, and the flow passage can be opened/closed, wherein the diffuser cone includes: a diffuser cone body which forms a fluid passage at the outer periphery between the diffuser cone and the diffuser casing in an opened state; a diffuser cone cover which is removably coupled on the diffuser cone body while leaving at least a space between the diffuser cone cover and the diffuser cone body; and a motor means fixedly provided in the space.

The motor means 60 may have a configuration which allows the diffuser cone 10 to be upwardly/downwardly moved during rotation of the motor means, in which the motor means 60 has a lead screw 62 connected to a motor rotation shaft 61, and the lead screw 62 rotatably protrudes outside the center of the space 13 of the diffuser cone body 11. Also, the diffuser may further include: a guide means which prevents the diffuser cone 10 from being rotated and allows the diffuser cone to be only upwardly/downwardly moved; and a fixing/supporting member 15 which guides the upward/downward movement of the guide means 18 and is provided with a fixing nut 65 to be engaged with the lead screw 62. Also, the diffuser casing 20 includes: an outer casing 22 fixed at a duct 40; and an inner casing 21 having an outer coupling portion 21*d*, the outer coupling portion 21*d* being designed to be coupled with an inner coupling portion 22*d* of the outer casing, wherein in the inner casing, the fixing/supporting member 15 is provided. Also, coupling parts 15 and 26 are provided, respectively, in an outer periphery of the fixing/supporting member 15, and an inner periphery of the diffuser casing 20, in such a manner that the fixing/supporting member 15 is removably coupled with respect to the diffuser casing 20. Also, a space between the diffuser cone 10 and the diffuser casing 20 is preferably, airtightly sealed by a sealing member 14. Within the diffuser cone, as required, a control means for the control of a motor, and a PCB substrate such as a PCB circuit, may be internally provided.

BRIEF DESCRIPTION OF THE DRAWINGS

The foregoing and other objects, features and advantages of the present invention will become more apparent from the following detailed description when taken in conjunction with the accompanying drawings in which.

BEST MODE

Mode for Invention

Hereinafter, preferred embodiments of the present invention will be described with reference to the accompanying drawings. However, the present invention is not limited thereto.

Figure 1:
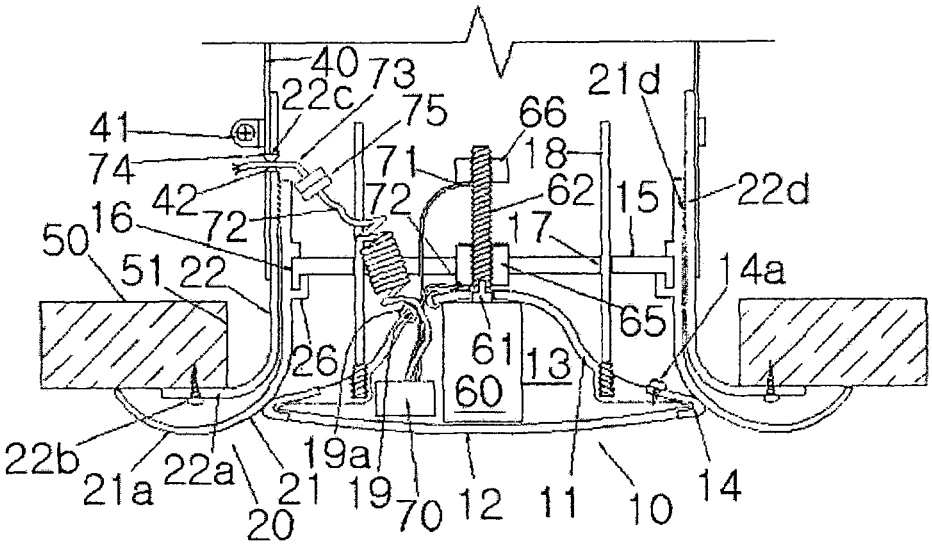
FIG. 1 is a cross-sectional view illustrating the configuration of a diffuser having a square- or circular-cross section, in a closed state, according to one embodiment of the present invention.
Figure 2:
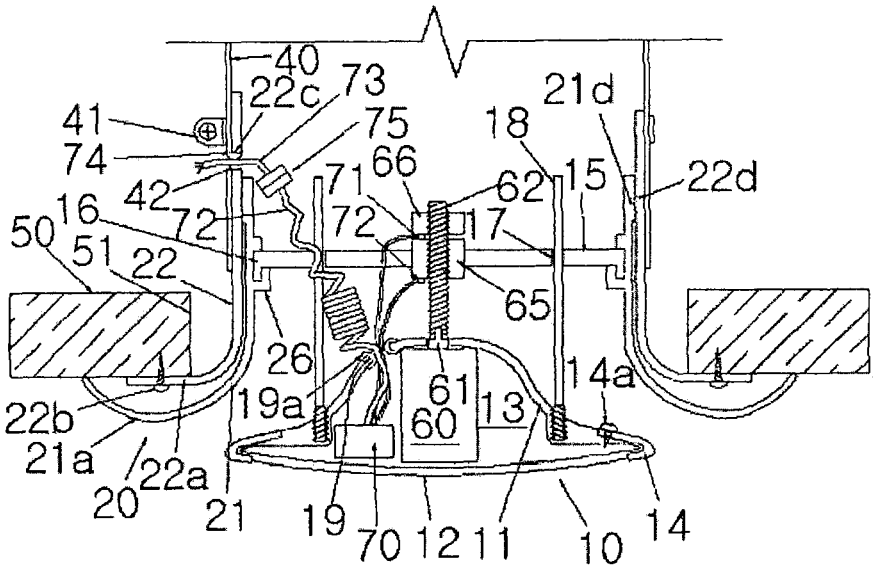
FIG. 2 is a cross-sectional view illustrating the configuration of a diffuser shown in FIG. 1, in an opened state.
Figure 3:
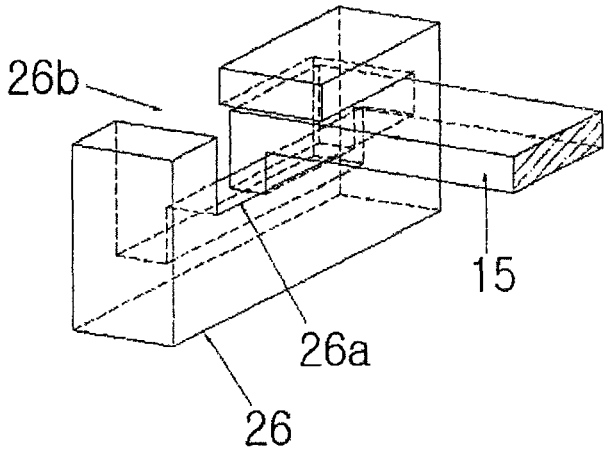
FIG. 3 is a partial perspective view illustrating an example of the configuration shown in FIG. 1, in which a fixing-supporting member and an inner casing are coupled.
Figure 4:
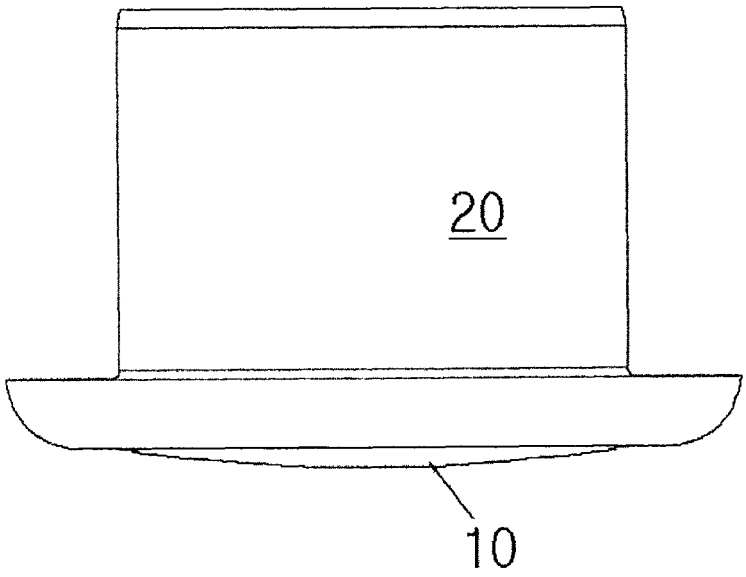
FIG. 4 is a front view illustrating a diffuser according to another embodiment of the present invention.
Figure 5:
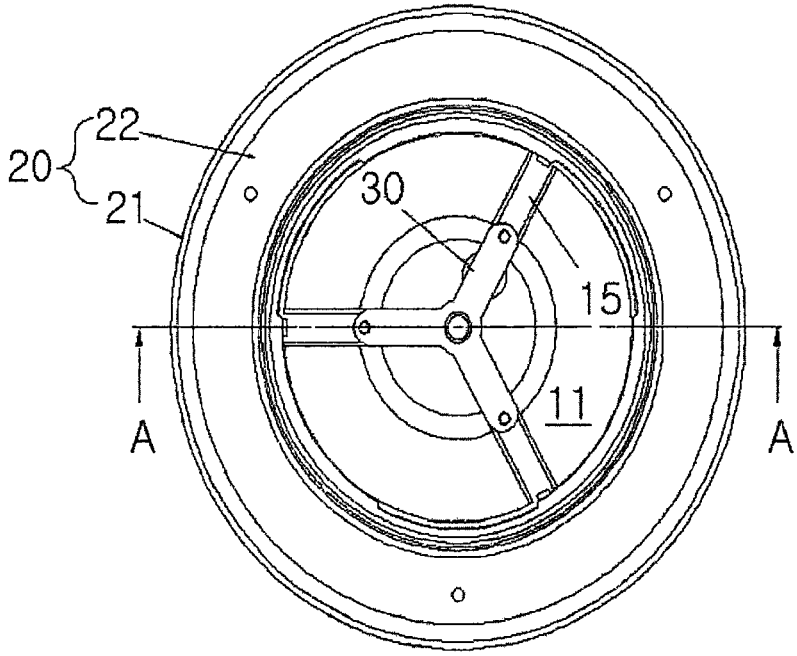
FIG. 5 is a top plan view of FIG. 4.

FIGS. 1 and 2 are cross-sectional views illustrating a state where a diffuser according to one embodiment of the present invention is provided in a diffuser mounting hole 51 of a ceiling 50 and operated; FIG. 3 is a partial perspective view illustrating an example of the diffuser shown in FIGS. 1 and 2, in which a fixing-supporting member and an inner casing are coupled; and FIGS. 4 to 7 are views illustrating a configuration of a diffuser according to another embodiment of the present invention.

The diffuser shown in FIGS. 1 and 2 include a diffuser cone 10 with a square- or circular-cross section, and a diffuser casing 20, in a similar manner to a conventional diffuser. The diffuser casing 20 include an outer casing 22 fixed at a duct, and an inner casing 21 having an outer coupling portion 21*d*, the outer coupling portion 21*d* being designed to be coupled with an inner coupling portion 22*d* of the outer casing 22. Especially, in the present embodiment, an outer casing 22 of the diffuser casing 20 is connected to a duct 40 and is fixed by a clamp 41. Also, in the present embodiment, as shown in FIGS. 1 and 2, a flange 22*a* of the outer casing 22 is fixed at the ceiling 50 by a screw 22*b*, and an inner casing 21 is coupled with the outer casing 22 by coupling parts 16 and 26. The coupling parts 16 and 26 may have various coupling types. Also, the diffuser cone 10 is upward/downward movably provided with respect to the diffuser casing 20 in such a manner that an opening rate of a flow passage at an outer periphery between the diffuser cone and the diffuser casing 20 can be controlled, and the flow passage can be opened/closed.

Also, the present invention is not limited to the configuration of the diffuser and the diffuser casing 20 as described above, and may be applied to various configuration of the diffuser casing 20, and a case with no diffuser casing 20. Especially, the diffuser cone according to the present invention may be applied to various structures where the diffuser cone is not upwardly/downwardly moved.

The diffuser cone 10 according to the present invention, as shown in FIGS. 1 and 2, includes: a diffuser cone body 11 which forms a fluid passage at the outer periphery between the diffuser cone and the diffuser casing in an opened state; a diffuser cone cover 12 which is removably coupled on the diffuser cone body while leaving at least a space 13 between the diffuser cone cover and the diffuser cone body; and a motor means 60 fixedly provided in the space 13.

Preferably, a lock sealing member 14 is provided so that airtightness can be secured when the diffuser cone 10 and the diffuser casing 20 are closed. Also, it is preferable in view of maintenance that a PCB substrate 70 for controlling the motor means 60 is provided in the space 13. In this case, cables 72 and 73 are connected via a connector 75 so that they can be easily and completely detached when the diffuser cone 10 is disassembled. Numerals 19, 22*c*, and 42 indicate through-holes of the cables 72 and 73, and in the through-holes, sealing members 19*a* and 74 are preferably provided so as to secure airtightness.

Figure 6:
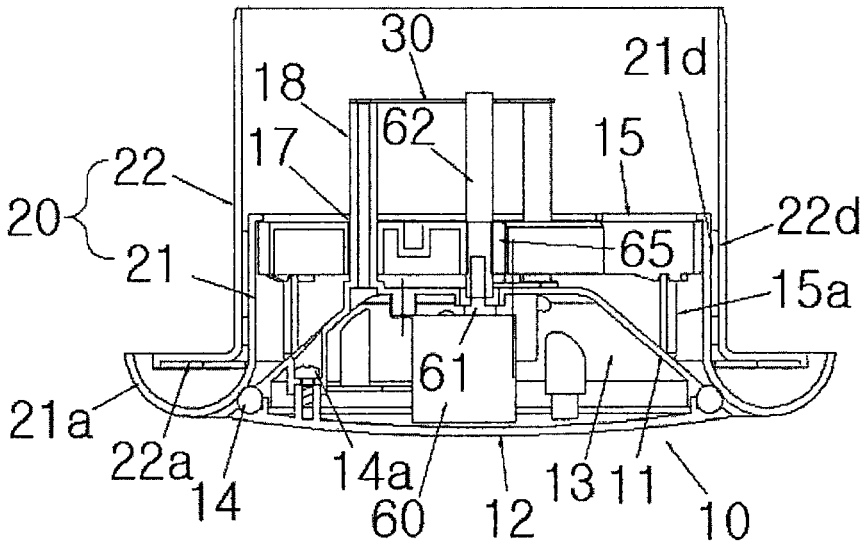
FIG. 6 is a cross-sectional view along line A-A of FIG. 5, in a closed state.
Figure 7:
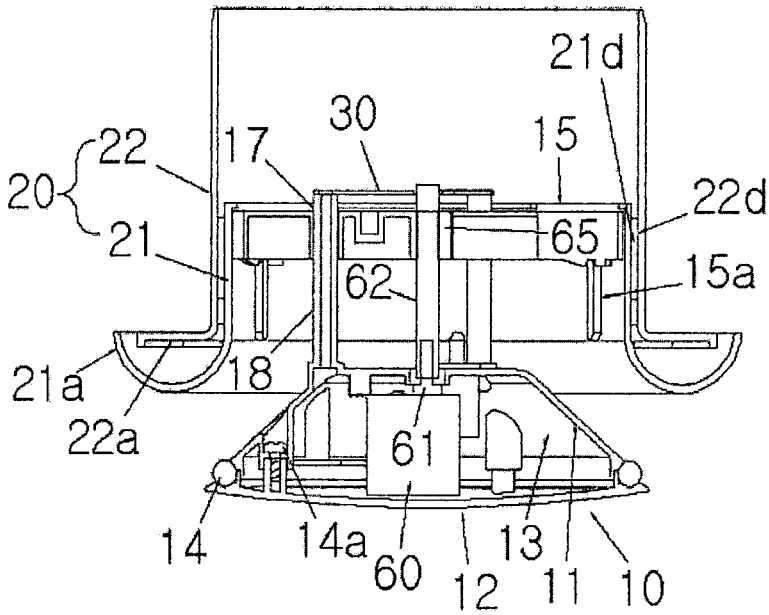
FIG. 7 is a cross-sectional view along line A-A of FIG. 5, in an opened state.

The diffuser cone body 11 and the diffuser cone cover 12, as shown in the embodiment of FIGS. 1 and 2, are removably coupled by a screw 14*a* through interposition of the sealing member 14, and also, as shown in the embodiment of FIGS. 6 and 7, may be directly fixed by a screw 14*a*. As the motor means 60, a geared motor using DC power may be generally employed, but the present invention is not limited thereto.

Also, as shown in FIGS. 1 and 2, the motor means 60 may have a configuration for upward/downward movement of the diffuser cone 10, in which the motor means 60 has a lead screw 62 connected to a motor rotation shaft 61, and the lead screw 62 rotatably protrudes outside the center of the space 13 of the diffuser cone body 11.

In a case where the opening rate is controlled by upward/downward movement of the diffuser cone 10, there is required a guiding means which prevents the diffuser cone 10 from being rotated and allows the diffuser cone to be only upwardly/downwardly moved when the motor means 60 is rotated. As one example, the configuration shown in FIGS. 1 and 2 may include: at least one rod-shaped guide means 18; a through hole 17 guiding the upward/downward movement of the guide means 18; and a fixing/supporting member 15 provided in the inner casing 21 of the diffuser casing 20. Also, a fixing nut 65 to be engaged with the lead screw 62 is fixedly provided in the fixing/supporting member 15.

Also, the fixing/supporting member 15 may be disassembledly provided in the inner casing 21. As one example, as shown in FIG. 3, the coupling part 16 is formed in a ¬-bent shape at each end portion of the fixing/supporting member 15. In the inner casing 21, a groove-shaped coupling groove 26*a* into which the coupling part 16 of the fixing/supporting member 15 is inserted is provided in the coupling part 26, and also a through hole 26*b* allowing the coupling part 16 of the fixing/supporting member 15 to go in and out of the coupling groove 26*a* is provided. Through the configuration as described above, when the fixing/supporting member 15 is assembled, the coupling part 16 of the fixing/supporting member 15 is inserted through the through hole 26*b*, and is slightly rotated within the coupling groove 26*a* of the inner casing 21 so that it is not escaped. Meanwhile, for disassembling, the operation is inversely carried out.

Also, in the configuration as shown, after the disassembling/assembling of the fixing/supporting member 15, the diffuser cone cover 12 is disassembled/assembled from/to the diffuser cone body 11. However, only the diffuser cone cover 12 may be directly disassembled/assembled from/to the diffuser cone body 11 from the outside.

In order to restrict the upward/downward movement of the diffuser cone 10, limit switches 71 and 72 may be provided. Especially, a maximum opening rate control nut 66 may be provided together with the switches, so that it can perform a role of a stopper and at the same time can control the maximum opening rate of the diffuser cone 10. This inhibits unnecessary openings in the application of various conditions, thereby inhibiting the waste of energy.

When the above described diffuser for indoor ventilation or building's cooling and heating, according to one embodiment of the present invention, is provided in the ceiling 50, the checking or the maintenance of the motor means 60 or the PCB substrate 70 may be easily carried out by separating the diffuser cone 10 from the diffuser casing 20, and by separating the diffuser cone cover 12 of the diffuser cone 10 from the diffuser cone body 11. Also, when the control nut 66 is required to be controlled, the control is carried out by separating the diffuser cone 10 from the diffuser casing 20. Especially, in a case where the fixing/supporting member 15 and the coupling parts 16 and 26 of the inner casing 21 are configured as shown in FIG. 3, the diffuser cone 10 may be separated from the diffuser casing 20 by being separated from the through hole 26*b* while the diffuser cone 10 is slightly rotated in a disassembling direction, and is lifted from the coupling groove 26*a*. Also, the assembling of the diffuser cone is carried out in a reverse order to that of the disassembling. As mentioned above, disassembling and assembling of the diffuser cone 10 and the diffuser casing 20 are not limited thereto.

A diffuser according to another embodiment of the present invention, as shown in FIGS. 4 to 7, has a similar configuration to that shown in FIGS. 1 to 3, and thus its components are denoted by the same numerals, and explanations thereof are omitted. Furthermore, a part of the configuration of the diffuser is omitted. However, in FIGS. 4 to 7, the diffuser cone body 11 and the diffuser cone cover 12 are configured in such a manner that they are removably coupled by a screw 14*a*. Also, the sealing member 14 is provided at the outer periphery of the contact portion between the diffuser cone cover 12 and the diffuser cone body 11. Also, three guide means 18 are integratedly formed in the diffuser cone body 11. The end portions of the plurality of guide means 18 are fixed by a fixing member 30 so that the diffuser cone 10 can be stably upwardly/downwardly moved. A fixing member 15*a* is provided in the fixing/supporting member 15 so that it can stably support the diffuser cone body 11 when the diffuser cone 10 is closed.

The diffuser according to the present invention, as configured and described above, may be employed for indoor ventilation or building's cooling and heating. Also, since the motor means 60 and the PCB substrate 70 together with the diffuser cone 10 are disassembledly configured, a maintenance hole is not required. Thus, a ceiling can be beautifully configured. In a case of a configuration where only the diffuser cone cover 12 is directly disassembled from the outside, simple maintenance can be more simply carried out.

Also, the diffuser cone 10, when not in use, can be closed, and displacement control of the diffuser cone 10 is easy, which allows air volume control to be proportionally carried out. Furthermore, a maximum opening rate can be controlled by the control nut 66 according to conditions, which contributes to energy reduction of a building.

Also, the diffuser has a simple configuration and its maintenance can be easily carried out due to ease of disassembling/assembling. Furthermore, the motor means 60 or the PCB substrate 70 is internally mounted to minimize the possibility of break-down, and reduce a flow resistance thanks to no obstruction to the flow passage.

INDUSTRIAL APPLICABILITY

The diffuser according to the present invention, as described above, which is applied for indoor ventilation or building's cooling and heating, does not require a maintenance hole, and its displacement control is easy. Furthermore, when a space to be air conditioned is not used, the diffuser can be closed, which allows air volume control to be proportionally carried out. Thus, compared to an expensive VAV system generally used for such a purpose, the diffuser is very simple and cheap, thereby reducing an initial investment cost up to 50% or more. Furthermore, the diffuser has a performance superior to the VAV system, thereby greatly contributing to energy reduction of a building. Also, it is possible to easily carry out the maintenance due to ease of disassembling/assembling. Moreover, since there is no obstruction to the flow passage, it is possible to reduce a flow resistance.

Although several exemplary embodiments of the present invention have been described for illustrative purposes, those skilled in the art will appreciate that various modifications, additions and substitutions are possible, without departing from the scope and spirit of the invention as disclosed in the accompanying claims.

The invention claimed is:

1. A diffuser comprising a diffuser cone with a square- or circular-cross section, and a diffuser casing, the diffuser cone being provided with respect to the diffuser casing in such a manner that an opening rate of a flow passage at an outer periphery between the diffuser cone and the diffuser casing can be controlled, and the flow passage can be selectively opened and closed, wherein the diffuser cone comprises:

a diffuser cone body which forms a fluid passage at the outer periphery between the diffuser cone and the diffuser casing in an opened state;

a diffuser cone cover which is removably coupled to the diffuser cone body while leaving a space between the diffuser cone cover and the diffuser cone body;

a motor means fixedly provided in the space, a guide means which prevents the diffuser cone from being rotated and allows the diffuser cone to be only upwardly and downwardly moved during rotation of the motor means and the diffuser cone is upwardly/downwardly movable with respect to the diffuser casing;

a lead screw which is connected to a motor rotation shaft of the motor means while rotatably protruding outside a center of the space between the diffuser cone cover and the diffuser cone body;

a supporting member which guides upwardly/downwardly movement of the guide means and is provided with a fixing nut to be engaged with the lead screw, wherein the diffuser casing comprises:

an outer casing fixed at a duct;

an inner casing having an outer coupling portion, the outer coupling portion being designed to be coupled with an inner coupling portion of the outer casing, and wherein the supporting member is provided in the inner casing.

2. The diffuser as claimed in claim 1, wherein coupling parts are provided, respectively, in an outer periphery of the fixing/supporting member and an inner periphery of the diffuser casing, in such a manner that the fixing/supporting member is disassembled/assembled with respect to the diffuser casing.

3. The diffuser cone as claimed in claim 1, wherein a sealing member is provided so that airtightness between the diffuser cone and the diffuser casing can be secured when a space between the diffuser cone and the diffuser casing is closed, and wherein a PCB substrate is internally provided.

4. A diffuser comprising a diffuser cone with a square- or circular-cross section, and a diffuser casing, the diffuser cone being provided with respect to the diffuser casing in such a manner that an opening rate of a flow passage at an outer periphery between the diffuser cone and the diffuser casing can be controlled, and the flow passage can be opened/closed, wherein the diffuser cone comprises:

a diffuser cone body which forms a fluid passage at the outer periphery between the diffuser cone and the diffuser casing in an opened state;

a diffuser cone cover which is removably coupled to on the diffuser cone body while leaving a space between the diffuser cone cover and the diffuser cone body;

a motor means fixedly provided in the space;

a guide means which prevents the diffuser cone from being rotated and allows the diffuser cone to be only upwardly/downwardly moved during rotation of the motor means when the diffuser cone is upward/downward moved with respect to the diffuser casing;

a lead screw which is connected to a motor rotation shaft of the motor means while rotatably protruding outside a center of the space between the diffuser cone cover and the diffuser cone body; and a supporting member which guides upward/downward movement of the guide means and is provided with a fixing nut to be engaged with the lead screw, and wherein coupling parts are provided, respectively, in an outer periphery of the supporting member and an inner periphery of the diffuser casing, in such a manner that the supporting member is removably coupled with respect to the diffuser casing.

5. The diffuser as claimed in claim 4, wherein the diffuser casing comprises:

an outer casing fixed at a duct;

an inner casing having an outer coupling portion, the outer coupling portion being designed to be coupled with an inner coupling portion of the outer casing, and wherein the supporting member is provided in the inner casing.

6. The diffuser cone as claimed in claim 4, wherein a sealing member is provided so that airtightness between the diffuser cone and the diffuser casing can be secured when a space between the diffuser cone and the diffuser casing is closed, and wherein a PCB substrate is provided inside the diffuser cone.

* * * * *